United States Patent [19]

Crockett

[11] Patent Number: 5,014,853

[45] Date of Patent: May 14, 1991

[54] FOOD DELIVERY BOX

[76] Inventor: Eric T. Crockett, 3854 Clareridge, Toledo, Ohio 43623

[21] Appl. No.: 562,499

[22] Filed: Aug. 2, 1990

[51] Int. Cl.[5] ..... B65D 5/54

[52] U.S. Cl. ..... 206/602; 229/103; 229/906

[58] Field of Search ..... 229/103, 902, 906, 8; 206/602, 551; 426/111, 115

[56] References Cited

U.S. PATENT DOCUMENTS

| | | | |
|---|---|---|---|
| 3,335,846 | 8/1967 | Mills | 206/551 |
| 3,580,484 | 5/1971 | Schneider | 206/551 |
| 3,771,713 | 11/1973 | Davidson | 229/906 |
| 4,746,010 | 5/1988 | Fournier | 206/602 |

FOREIGN PATENT DOCUMENTS

| | | | |
|---|---|---|---|
| 1047592 | 7/1953 | France | 229/8 |
| 406051 | 1/1966 | Switzerland | 229/8 |
| 1455937 | 11/1976 | United Kingdom | 206/602 |

*Primary Examiner*—Gary E. Elkins

*Attorney, Agent, or Firm*—Dykema Gossett

[57] ABSTRACT

The present invention relates to a food container and more particularly to a pizza box for delivering pizzas. The box can be separated into sections that form plates on which the pizza or other type of food can be eaten. The box incudes a bottom portion that forms a storage area and a top portion that is perforated to define sections or plates. These perforations extend from a point substantially central to the top panel through the flaps. The sections can be separated along the perforations to form plates with sides which can be held to eat the pizza or other food.

16 Claims, 2 Drawing Sheets

FOOD DELIVERY BOX

BACKGROUND OF THE INVENTION

The present invention relates to an improved food container and more particularly to an improved pizza delivery box.

It is well known that the market for delivered food and in particular delivered pizza is becoming increasingly competitive. Successful competitors must provide fast delivery of oven fresh food in the most convenient and cost effective manner possible. One convenience is the delivery of plates and eating utensils with the delivered food. This allows the customer of eat the food without having to locate utensils and plates, for example at an office, and doesn't require washing of the utensils and plates after the meal is completed.

Of course, providing utensils and plates is a convenience, but it also increases the cost of the delivered product and requires additional handling by employees which also increases costs.

SUMMARY OF THE INVENTION

The present invention provides an improved delivery box which has perforations that define plates which can be separated from the box for eating the delivered food. The box includes a bottom portion with sides that forms a storage area and a top portion with flaps which can be closed to cover the bottom portion. In the preferred embodiment, the top portion is perforated to define sections or plates, with it being understood that the bottom of the box can be perforated as well to provide additional plates. These perforations extend from a point substantially central to the panel through the flaps. The sections can be separated along the perforations to form plates with sides.

In one embodiment of the invention, the box is substantially rectangular or square. The flaps are formed along the periphery of the box top. The top, and if desired the bottom are perforated to form at least four sections with each section including portions of adjoining flaps. The perforations intersect the flaps at approximately their midpoint. The top and flaps can be separated from the box bottom which leaves the top portion with four flaps attached. The top and the flaps can then be separated along the perforations to provide four plates. Each plate is generally diamond shaped with flaps on two adjoining sides of the diamond. These flaps give support to the plate and function as handles which can be grasped to hold the plate while eating. To improve gripping, holes can be provided in each of the flaps for receipt of a user's index finger and thumb with the remaining fingers extending under the plate to hold it while eating.

In another embodiment, the box is circular in shape. With the circular box, the sections radiate from the center of the box and intersect the flaps preferably at their midpoint. The box can be separated and used in the same manner as the rectangular box.

In still another embodiment of the present invention a compartment is provided in the delivery box for storing eating utensils. This compartment can be formed by making one of the sides longer and forming fold lines in it so that it can be folded into a compartment and function as a side of the delivery box as well. It can also be a separate compartment which is fastened to the delivery box. Utensils can be inserted into the box at the time the box is folded so that it is ready for delivery when the order is ready. Additionally, the utensils could be inserted by the box manufacturer when the box is made so that no handling by the restaurant is required.

DETAILED DESCRIPTION OF THE INVENTION

Figure 1:
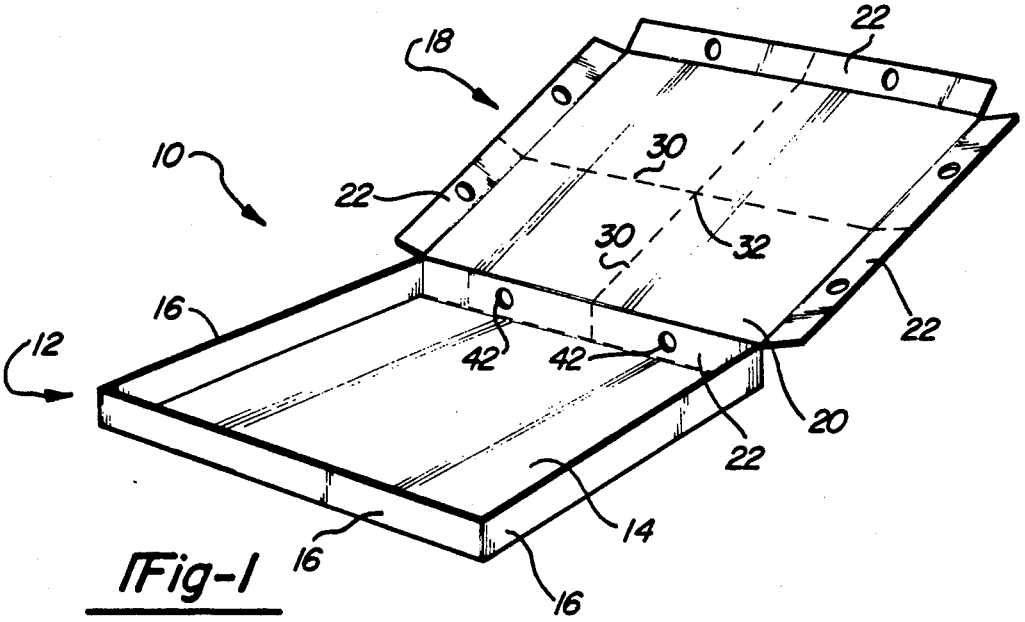
FIG. 1 is a perspective view of one embodiment of the invention illustrating the delivery box with perforations.

With reference to FIG. 1, the first embodiment of the delivery box of the present invention is shown generally at 10. The box has a bottom portion 12 having a bottom panel 14 and sides 16 that forms a storage area. Attached to the bottom portion 12 is a top portion 18 which has a top panel 20 and flaps 22. One of the flaps 22 is attached to the bottom portion 12 so that the top 10 can be closed. Flaps 22 can be folded perpendicular to top panel 20 for receipt by bottom portion 12 when the top 10 is closed.

In one embodiment, the top portion 10 is perforated at 30 to define sections or plates. It should be understood that the bottom portion 12 of the box can be perforated as well to provide additional plates. Preferably, perforations 30 begin at a point 32 which is generally at the center of panel 20 and extend through the approximate midpoint of each flap 22. This permits the top 10 to be separated along the perforations to form plates.

Figure 2:
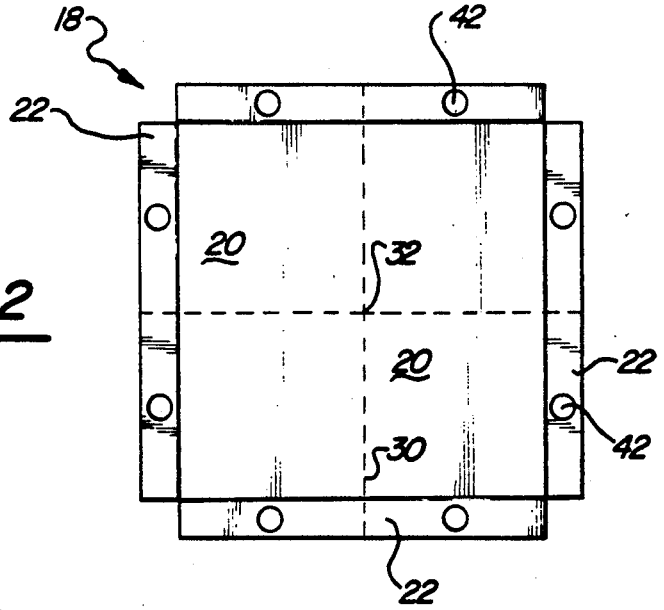
FIG. 2 is a top view of the box top when removed from the box bottom.

With reference to FIG. 2, the top portion 10 is shown separated from the bottom portion 12. The separated top portion includes the top panel 20 and four flaps 22 positioned along the outer perimeter of the top panel 20.

Figure 3:
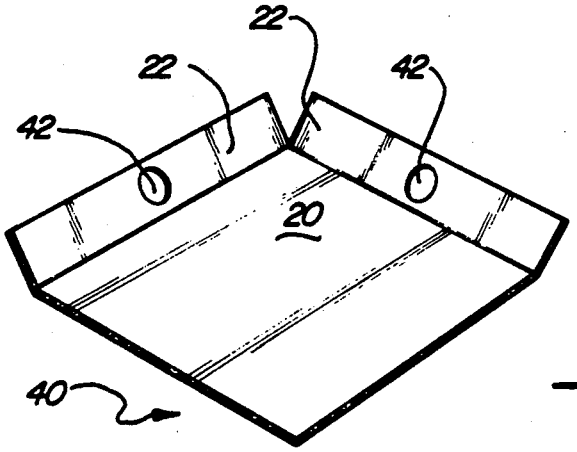
FIG. 3 is a perspective view of a separated plate.

In FIG. 3, a separated plate of the preferred embodiment of is shown generally at 40. Plate 40 includes a portion of the top panel 20 and a portion of two adjoining flaps 22. In this embodiment, plate 40 is diamond shaped with adjoining flaps 22 at one end. Flaps 22 give support to plate 40 and function as handles which can be grasped to hold the plate while eating. To improve gripping, holes 42 are provided in each of the flaps for receipt of a user's index finger and thumb with the remaining fingers extending under the plate to hold it while eating.

Figure 4:
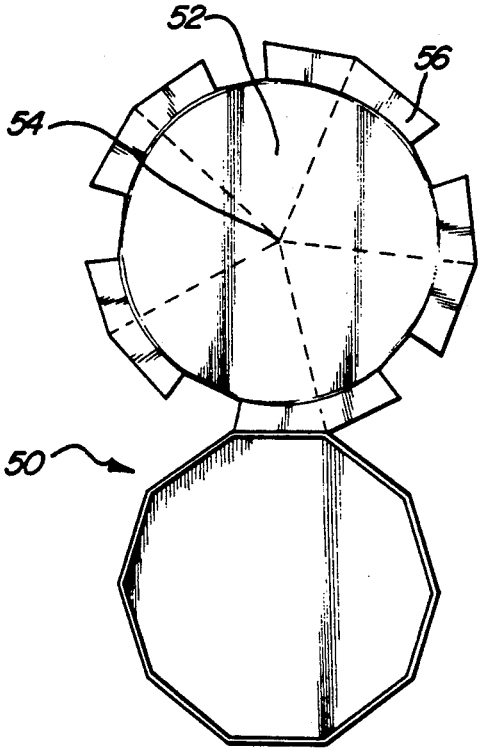
FIG. 4 is a perspective view illustrating the delivery box with perforations.

With reference to FIG. 4, a further embodiment of the present invention is shown generally at 50. In this embodiment the box 50 is circular in shape. With the circular box, the sections of plates 52 radiate from the approximate center 54 of the box and generally intersect flaps 56 at their midpoint. The box can be separated and used in the same manner as the rectangular box described above. In this embodiment, the plate is substantially pie shaped as opposed to being diamond shaped as in the previous embodiment.

Figure 5:
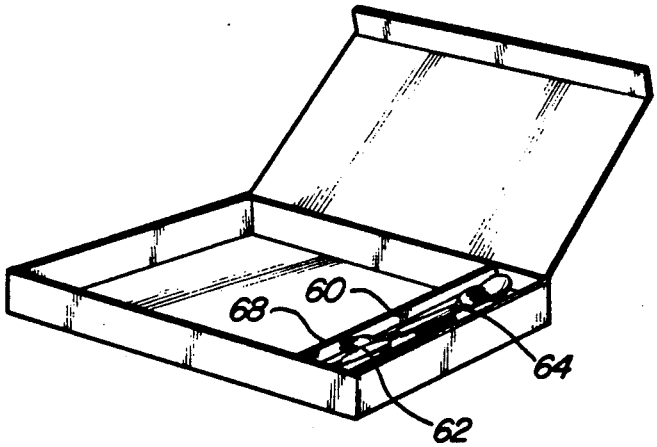
FIG. 5 is a partial perspective view of a delivery box having a utensil compartment.

A further embodiment of the present invention is illustrated in FIG. 5. In this embodiment, a compartment 60 is provided in the box for storing eating utensils, napkins, etc. which are shown generally at 62. This compartment can be formed by for example making one of the sides 16 longer and forming fold lines at 64 and 68 so that it can be folded into a compartment 60 and also function as a side 16 of the delivery box. Compartment 60 also can be made as a separate compartment and fastened to the side 16 of the delivery box.

Utensils 62 can be inserted into the box at the time the box is folded so that it is ready for delivery when the order is ready. This avoids the need to remember to insert utensils etc. Alternatively, the utensils could be inserted by the box manufacturer when the box is made so that no handling by the restaurant is required.

As should be apparent to one of ordinary skill in the art, the general box construction is the same as conventional boxes now employed by restaurants, particularly pizza restaurants with the exception of perforations to define plates that can be easily separated for use. This provides a convenient cost effective way to provide plates to customers. The perforations can easily be added in the box manufacturing process with very little if any added cost to the finished product. All that would be required to provide convenient plates in the box is a perforation machine to make the perforations which define the plates. The overall box construction would not change.

If the utensil compartment 60 is to be included the box manufacturer would need to allow for the longer side 16 and include fold lines so that the compartment can be formed. Of course, if the manufacturer inserts the utensils during manufacture, further manufacturing equipment would be needed.

It is to be understood that the foregoing disclosure relates only to preferred embodiments of the invention and that numerous modifications and alterations may be made without departing from the spirit and scope of the invention as set forth in the appended claims.

What is claimed is:

1. A food container comprising a bottom portion defined by a base panel and at least one side panel positioned substantially perpendicular to the base panel forming a storage area for the receipt of food and a top portion having a top panel and downwardly extending flaps which are hingedly connected to the top panel and can be folded perpendicular to the top panel for receipt by the bottom portion adjacent said side panel when the top portion is closed, at least one of the flaps being hingedly attached to the bottom portion such that the top portion can be opened and closed with respect to the bottom portion to cover the storage area, the top portion having perforations at least along the extent of the top panel which define at least four sections that extend from a point substantially central to the top panel to the outer edges of the top portion intersecting the flaps, each of the sections including a portion of the top panel and a portion of at least two adjoining flaps such that the top portion can be separated into plates with each plane having a section of the top panel and a section of at least two flaps with the section of the top panel forming the bottom of the plate and the flaps forming the sides of the plate.

2. The container of claim 1, wherein said container is substantially rectangular.

3. The container of claim 1, wherein said container is substantially circular.

4. The container of claim 1, wherein the top and bottom portions are substantially circular with the flaps being spaced about the perimeter of the top portion with the perforations radiating from a substantially central point of the top portion intersecting the flaps at approximately the midpoint of each of the flaps.

5. The container of claim 4, wherein said perforations radiate from a substantially central point of the bottom portion intersecting the side at approximately the midpoint thereof.

6. The container of claim 1, wherein said perforations radiate from a substantially central point of the bottom portion intersecting the side at approximately the midpoint thereof.

7. The container of claim 1, wherein each of the flaps has an opening for receipt of a users fingers.

8. The container of claim 1, further including a utensil compartment.

9. A food container comprising a bottom portion defined by a base panel and at least a side panel which form a storage area for the receipt of food and a top portion having a top panel and downward extending flaps which are connected to the top panel and can be folded with respect to the top panel for receipt by the bottom portion adjacent the side panel when the top portion is closed, the top portion having perforations at least along the extent of the top panel which define sections that extend from a point substantially central to the top panel to the outer edges of the top portion intersecting the flaps, each of the sections including a portion of the top panel and a portion of the at least two adjoining flaps, whereby the top portion can be separated into plates with each plate having a section of the top panel and a section of at least two flaps with the top panel section forming the plate bottom and the flaps forming the plate sides.

10. The container of claim 9, wherein said container is substantially rectangular.

11. The container of claim 9, wherein said container is substantially circular.

12. The container of claim 9, wherein the top and bottom portions are substantially circular with the flaps being spaced about the perimeter of the top portion with the perforations radiating from a substantially central point of the top portion intersecting the flaps at approximately the midpoint of each of the flaps.

13. The container of claim 12, wherein said perforations radiate from a substantially central point of the bottom portion intersecting the side at approximately the midpoint thereof.

14. The container of claim 9, wherein said perforations radiate from a substantially central point of the bottom portion intersecting the side at approximately the midpoint thereof.

15. The container of claim 9, wherein each of the flaps has an opening for receipt of a users fingers.

16. The container of claim 9, further including a utensil compartment.

* * * * *

UNITED STATES PATENT AND TRADEMARK OFFICE

CERTIFICATE OF CORRECTION

PATENT NO. : 5,014,853

DATED : May 14, 1991

INVENTOR(S) : Eric Crockett

It is certified that error appears in the above-identified patent and that said Letters Patent is hereby corrected as shown below:

COLUMN 3:

In claim 1, line 58, please delete "plane" and add --plate--.

Signed and Sealed this

Eighth Day of September, 1992

*Attest:*

DOUGLAS B. COMER

*Attesting Officer*

*Acting Commissioner of Patents and Trademarks*